US007192390B2

(12) United States Patent
Berard

(10) Patent No.: US 7,192,390 B2
(45) Date of Patent: Mar. 20, 2007

(54) EXPANDER TYPE EXERCISE DEVICE

(76) Inventor: Rene Ernest Berard, 14235 - 83rd St., Edmonton, Alberta (CA) T5E 2X8

( * ) Notice: Subject to any disclaimer, the term of this patent is extended or adjusted under 35 U.S.C. 154(b) by 68 days.

(21) Appl. No.: 10/827,880

(22) Filed: Apr. 21, 2004

(65) Prior Publication Data

US 2005/0085356 A1 Apr. 21, 2005

Related U.S. Application Data

(63) Continuation-in-part of application No. 10/689,282, filed on Oct. 21, 2003, now abandoned.

(51) Int. Cl.
*A63B 21/02* (2006.01)
*A63B 21/045* (2006.01)

(52) U.S. Cl. ..... 482/126; 482/121; 482/128

(58) Field of Classification Search ..... 482/121, 482/122, 126, 44, 91, 92, 139, 907, 904, 482/128; D21/692
See application file for complete search history.

(56) References Cited

U.S. PATENT DOCUMENTS

| | | | | | |
|---|---|---|---|---|---|
| 2,035,010 | A | * | 3/1936 | Rawlings | 601/23 |
| 3,536,326 | A | * | 10/1970 | Georges | 482/126 |
| 3,592,467 | A | * | 7/1971 | Pereira | 482/126 |
| 3,785,645 | A | * | 1/1974 | Yosef | 482/126 |
| 4,290,600 | A | * | 9/1981 | Kolbel | 482/126 |
| D263,328 | S | * | 3/1982 | Cooper | D21/693 |
| 4,645,204 | A | * | 2/1987 | Berger | 482/123 |
| 4,909,505 | A | * | 3/1990 | Tee | 482/129 |
| 5,295,935 | A | * | 3/1994 | Wang | 482/130 |

* cited by examiner

*Primary Examiner*—Stephen R. Crow
*Assistant Examiner*—Allana Lewin

(57) ABSTRACT

There is now provided an expander type exercise device for performing physical workout exercise that can be configured in a simple manner to adjust the resiliency of an elastic strand for various physical workout exercises, by varying the length of the elastic strand that is disposed between two handgrips by means of which the elastic strand can be expanded by exerting a force of pull upon the elastic strand.

17 Claims, 9 Drawing Sheets

EXPANDER TYPE EXERCISE DEVICE

CROSS REFERENCE TO A RELATED PATENT APPLICATION

This is a continuation-in-part application of my U.S. patent application Ser. No. 10/689,282 filed on Oct. 21, 2003 now abandoned in Art Unit 3764.

BACKGROUND OF THE INVENTION

1. Field of the Invention

The present invention relates to an expander type exercise device.

2. Background Information

Expander type exercise devices are also referred to as pulling exercisers or strand-pulling exercisers. Such exercisers are intended to aid in performing a plurality of physical exercises that are conducive to improve the fitness of body muscles. Such exercise devices may serve to replace barbells or dumbbells for performing physical exercises.

Some typical expander type exercise devices are described in the following references.

U.S. Pat. No. 399,699 issued to Sachs on Mar. 19, 1889 and entitled "Exercising apparatus," shows a typical embodiment of a strand-pulling exercise device in which five elastic bands, either rubber or metallic springs, are individually respectively secured between handles. U.S. Pat. No. 2,930,614 issued to McIntosh on Mar. 29, 1960 and entitled "Body exercising device," discloses five separate elongated resilient, rubber, tubes connected between two handgrips. The tubes according to McIntosh are connected at the handgrips by way of ball elements. U.S. Pat. No. 3,677,543 issued to Richardson on Jul. 18, 1972 and entitled "Elastic pull type exerciser," discloses a single piece of elastic tubing with loops formed at the respective ends of the tubing that serve as the handgrips. An anchoring element is disposed at the portion of the tubing opposite to the handgrips. The anchoring element provides the counterweight for the pull type exerciser according to Richardson. U.S. Pat. No. 4,019,734 issued to Lee at al. on Apr. 26, 1977 and entitled "Elastic pull type isotonic/isometric exerciser," discloses a single, elastic, resistant length of latex rubber with respective handle portions to perform pulling exercises. U.S. Pat. No. 4,762,318 issued to Phillips et al. on Aug. 9, 1988 and entitled "Exerciser," discloses a single tension member that can be varied in length between two handgrips. U.S. Pat. No. 5,662,564 issued to Nelson on Sep. 2, 1997 and entitled "Exercise device," discloses a structure that includes a single belt. The single belt serves to resist swinging movement of an upper housing upon movement of a handle assembly that is actuated during an exercise. The belt is connected to a pair of sprockets that cooperate with a further, centrally located, sprocket. The centrally located sprocket meshes with the cogs on the pair of sprockets, such that rotation of the centrally located sprocket in clockwise or counter-clockwise directions will rotate the adjacent sprockets in opposed directions to thereby adjust the tension of the single belt. U.S. Pat. No. 5,885,196 issued to Gvoich on Mar. 23, 1999 and entitled "Multiple elastic cable exercise device," discloses three elastic cables, the respective ends of which are secured in the respective handles by way of conical plugs. U.S. Pat. No. 5,894,631 issued to Chiu on Apr. 20, 1999 and entitled "Handle structure for a chest pull," discloses a handle with a tapered passage for a sphere member that is sized to be movably retained in the tapered passage.

U.S. Pat. No. 6,151,758 issued to Chiu on Nov. 28, 2000 and entitled "Handle assembly for connecting resilient ropes," discloses a single rope that is passed through apertures in a pair of handles, with the rope being clamped in place in the handles by way of teardrop-shaped members.

The Applicant herein also conducted a search in the database of the U.S. Patent and Trademark Office with the search terms "exercise equipment." The search located 1543 titles. A total of 229 references of these 1543 titles were studied separately, but no pertinent references were developed.

Based on the disclosures described in the foregoing, my present invention is to overcome hitherto encountered limitations in terms of adjusting the operational resiliency or resistance of the elastic element and elements of an expander type exercise device or strand pulling exercise device.

Thus, my present invention, in one aspect thereof, is directed to the improvement wherein a plurality of tension modes can be accomplished for an increase of the number of possible physical exercises that can be performed with my expander type exerciser during physical workout therewith.

OBJECTS OF THE INVENTION

It is an object of the invention described below to solve the problems encountered on similar devices of the prior art.

It is also an object of the present invention to provide an expander type exercise device that allows quick and simple adjustment of the resiliency of the elastic element that is disposed between two handgrips.

It is further an object of the present invention to provide a kit comprising an expander type exercise device and structures that permit to secure the expander type exercise device to stationary features in a room in which physical exercises are carried out.

SUMMARY OF THE INVENTION

The invention teaches that these objects can be accomplished by an exercise device of the class of expander type exercisers and strand pulling exercisers in which an elastic member that is capable of expansion and contraction is disposed between a pair of handgrips that are configured to expand the elastic member for physical workout exercises by a user, said exercise device comprising: (a) a first handgrip and a second handgrip; each handgrip comprising a handle portion being configured to be held by a user; each handle portion comprising a first plane; said first plane comprising a substantial vertical plane when a corresponding handgrip is held by a hand of a user; each handle portion comprising a base portion being configured with a groove to mount a plurality of roller elements; each grooved base portion disposing a corresponding groove opening in the direction remote from a corresponding handle portion; (b) a group of at least four roller elements being configured to be mounted in the grooved base portion of said first handgrip; a group of at least four roller elements being configured to be mounted in the grooved base portion of said second said second handgrip; each roller element having a longitudinal axis of rotation being disposed to extend transversely in reference to a corresponding first plane of a corresponding handgrip; each roller element comprising a circumferential groove disposed transversely in reference to a corresponding longitudinal axis of a corresponding roller element; (c) for each roller element, a shaft structure being configured to be disposed in a corresponding grooved base portion and also being configured to mount a corresponding roller element in a corresponding grooved base portion; and (d) a single elastic strand element being configured to expand upon being pulled by a force of pull and being configured to contract upon release of a force of pull; said single elastic strand element being configured to be selectively disposed about said group of at least four roller elements of said first handgrip and said group of at least four roller elements of said second handgrip and between said first handgrip and said second handgrip in a first formation and in at least one other formation; said first formation comprising eight portions of said single elastic strand element being disposed about said group of at least four roller elements of said first handgrip and also about said group of at least four roller elements of said second handgrip, and between said first handgrip and said second handgrip; said at least one other formation comprising four portions of said single elastic strand element being disposed about at least two roller elements of said group of at least four grooved roller elements of said first handgrip and about at least two grooved roller elements of said group of at least four roller elements of said second handgrip, and between said first handgrip and said second handgrip.

The invention further teaches that these objects can be accomplished by a kit for performing physical workout exercises, said kit comprising: an expander type exercise device for use in performing physical workout exercises by a user, said exercise device comprising: (a) a first handgrip and a second handgrip; each handgrip comprising a handle portion configured to be grasped by a hand of a user; each handle portion comprising at least one mounting portion configured and disposed to removably dispose a guide element; (b) at least one guide element; each said at least one guide element being configured to be removably disposed in said at portion configured and disposed to removably dispose a guide element, of a corresponding handle portion of each said first handgrip and said second handgrip; (c) for each said at least one guide element, at least one structure being configured to dispose a corresponding guide element for rotation at a corresponding handgrip; and (d) an elastic element being configured to be disposed as an endless band about a respective guide element of said first handgrip and also about a respective guide element of said second handgrip to permit expansion and contraction of said elastic element between said first handgrip and said second handgrip upon performing physical workout exercises; and (B) a structure configured to be secured at one of: a wall and a door of a room; said structure also being configured to connect a handgrip for performing physical exercises.

The invention also teaches that these objects can be attained by an expander type exercise device for use in performing physical workout exercises by a user, said exercise device comprising: (a) a first handgrip and a second handgrip; each handgrip comprising a handle portion being configured to be grasped by a hand of a user; each handle portion comprising at least one portion being configured and disposed to removably retain a guide element; (b) at least one guide element for each handgrip; said guide element being configured to be removably disposed in said retaining portion of a corresponding handgrip; (c) a structure being configured to mount a corresponding guide element for rotation at a corresponding handgrip; and (d) an elastic element being configured to be disposed as an endless band about a respective guide element of said first handgrip and also about a respective guide element of said second handgrip to permit expansion and contraction of said elastic element between said first handgrip and said second handgrip upon performing physical workout exercises.

The above-discussed embodiments of the present invention will be described further hereinbelow. When the word "invention" is used in this specification, the word "invention" includes "inventions", that is the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the embodiments which are illustrated in the accompanying drawings.

DESCRIPTION OF THE PREFERRED EMBODIMENTS

Figure 1:
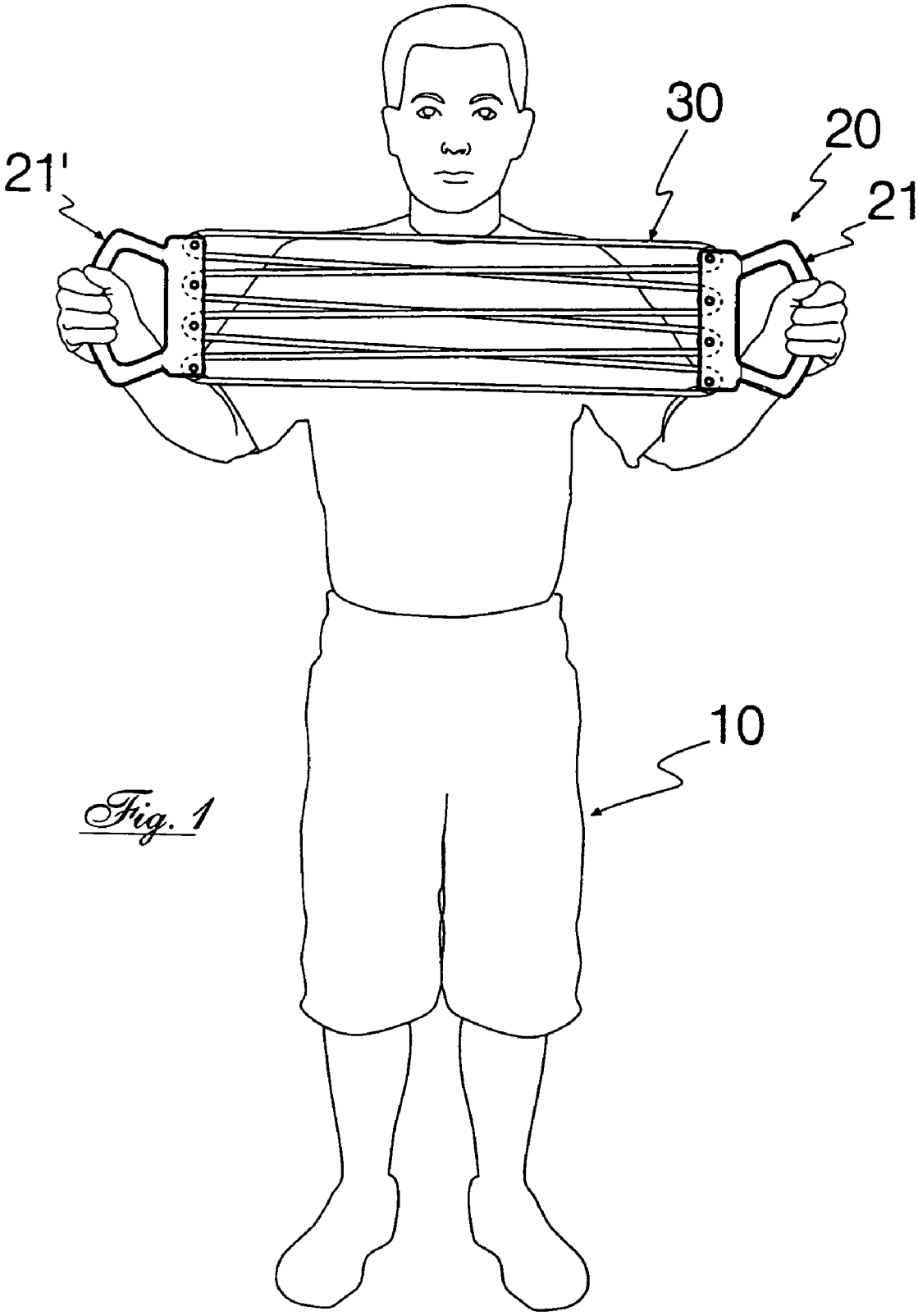
FIG. 1 shows the basic structure and use of the expander type exerciser device in accordance with one embodiment of my present invention.

FIG. 1 illustrates a user 10 holding the expander type exercise device 20 by the right handgrip 21 and by the left handgrip 21'. In one embodiment of the invention, the handgrips are identical in structure, but different numerals are used in this description to identify left and right. Thus, in this description, the reference to left and right and top and bottom and like designations is in reference to the pictorial representation of the drawings as viewed by an observer.

Elastic element 30 is disposed in eight portions between handgrip 21 and handgrip 21'. The elastic element 30 is preferably an elastic tubular element, such as, sold under the trademark THERABAND™. THERABAND™ is used in physical therapy clinics and is available in drugstores and 10 similar outlets. THERABAND™ is produced by THERABAND INC., Akron, Ohio, in various colors and sizes, colors being yellow, red, green, blue, and black. The colon may indicate different tensile strengths or expansion and contraction properties or the resistance grade. PRIMELINE INDUSTRIES of Akron, Ohio, produces similar tubular elements. The size of the tubular element 30 may be in the range of from ⅛ of an inch (3.15 mm) outer diameter and {fraction 1/32)} of an inch (0.80 mm) wall thickness with {fraction (1/16)} of an inch (1.59 mm) inner diameter, to ½ of an inch (12.70 mm) outer diameter with ⅛ of an inch (3.15 mm) wall thickness and ¼ of an inch (6.35 mm) inner diameter and all manufactured and possible sizes in between and other sizes and dimensions as desired for a given situation. The tubular element 30 may be selected with a tensile configuration that is useful for a beginner of my exercise device 20, for an advanced user of my exercise device 20, or an intermediate user of my exercise device 20. However, other elastic elements that can be expanded from its original state by application of a pulling force and that contract upon release of the pulling force to its original state may equally be used.

Figure 2:
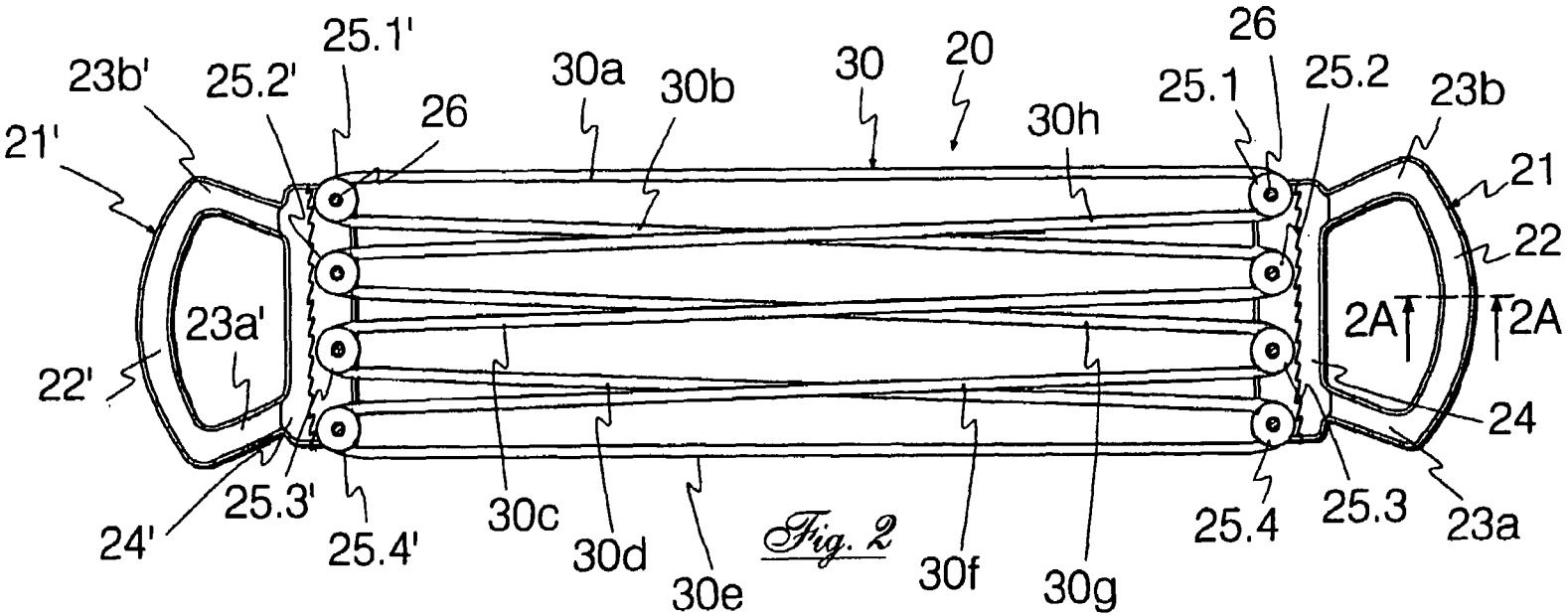
FIG. 2 is a diagrammatic illustration of the expander type exercise device according to FIG. 1 with utilization of eight portions of the elastic element in accordance with one embodiment of my present invention.

FIG. 2 is an illustration of my expander type exercise device 20 in the configuration that is regarded as the basic configuration of the elastic element 30 between handgrip 21 and handgrip 21'. This configuration is particularly intended for performing physical exercises that develop and/or strengthen the muscles of the arms and upper torso of a user 10.

FIG. 2 shows a first, right, handgrip 21 that has a handle portion or grip portion 22 that is configured to be gripped by a hand of a user 10. Connected next to handle portion 22 is a pair of side members 23*a* and 23*b* that serve to connect the handle portion 22 to a roller element mounting portion 24 that is configured to mount and dispose four rollers, 25.1, 25.2, 25.3, and 25.4.

FIG. 2 further shows a second, left, handgrip 21' which correspondingly comprises a handle portion or grip portion 22' that is configured to be gripped by the other hand of a user 10, in this illustration, the left hand. Connected next to handle portion 22' is a pair of side members 23*a'* and 23*b'* that serve to connect the handle portion 22' to a roller element mounting portion 24' that is configured to mount or dispose four rollers, 25.1', 25.2', 25.3', and 25.4'. Thus, the handgrips 21 and 21' are substantially identical to reduce cost of manufacture of my device 20, however, it is within the scope of my invention that the handgrips are dissimilar, but would each provide a means to mount or dispose the roller elements 25.1 to 25.4, and 25.1' to 25.4' as is illustrated in FIG. 2.

The elastic element 30 is disposed about the two pairs of four roller elements or rollers 25 each, as is described next: Commencing from roller 25.1, portion 30*a* of elastic element 30 extends to the left to roller 25.1' and is disposed about roller 25.1'. The extent or portion of elastic element 30 from the roller 25.1' to the roller 25.2, on the right side, is designated 30*b*. Similarly, portion 30*c* of elastic element 30 extends from roller 25.3' to roller 25.2, and portion 30*d* extends from roller 25.3' to roller 25.4. Portion 30*e* extends from roller 25.4' to roller 25.4. Portion 30*f* extends from roller 25.4', over portion 30*d*, to roller 25.3, and portion 30*g* extends from roller 25.3 to roller 25.2' by passing under portion 30*c*. Finally, portion 30*h* extends from roller 25.2' to roller 25.1 by passing over portion 30*b*.

It will be appreciated that in this described example of my expander type exercise device 20, the elastic element 30 is disposed to give a rather firm resistance to pulling as would be desired by a user 10. In other words, the expander type exercise device 20 according to my invention provides, in this described embodiment, a greater resistance to being pulled than a single strand.

Figure 2B:
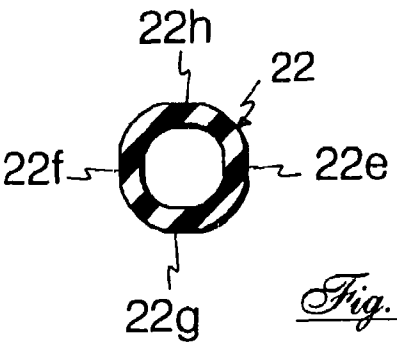
FIG. 2B is a cross-section similar to FIG. 2A and illustrating a possible different cross-sectional configuration.
Figure 2A:
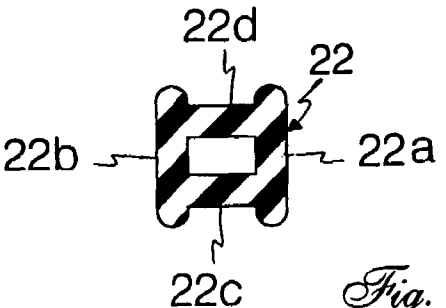
FIG. 2A is a cross-section along line 2A—2A in FIG. 2.

FIGS. 2A and 2B illustrate possible cross-sectional configurations of the handle portion 22. FIG. 2A shows a substantially square cross-section with walls 22*a*, 22*b*, 22*c*, and 22*d*. FIG. 2B illustrates a substantially circular cross-section with flat sides 22*e*, 22*f*, 22*g*, and 22*h*. However, other cross-sectional configurations and embodiments of the handle portion 22 are within the scope of my invention.

Merely by way of example, the distance between the handgrips 21 and 21' in FIG. 2 may be approximately 32 inches (81.3 cm).

My device is not limited to the configuration of elastic element 30, about the rollers 25, that is shown in and described with reference to FIG. 2.

Figure 3:
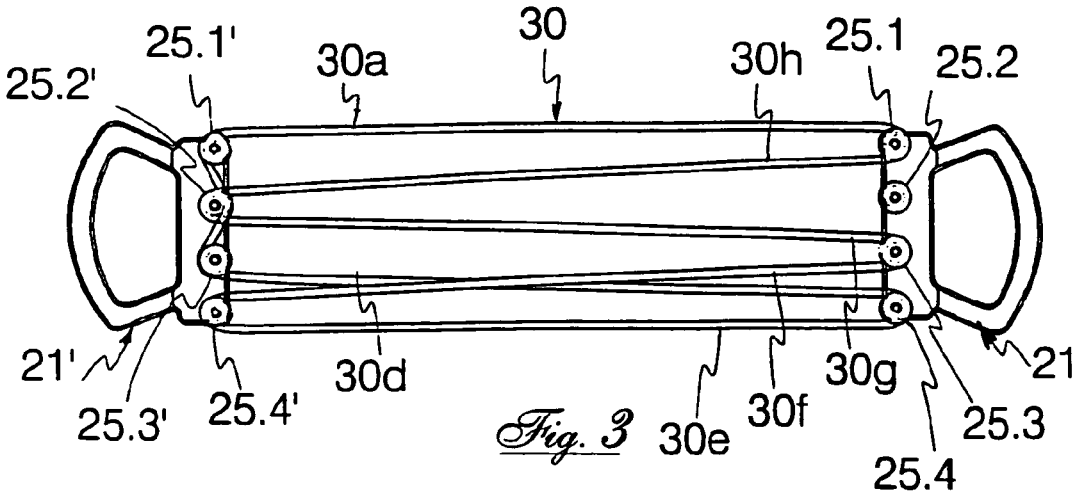
FIG. 3 is a diagrammatic representation of the expander type exercise device according to FIG. 1 with utilization of six portions of the elastic element in accordance with one embodiment of my present invention.

Thus, the elastic element 30 of the device 20 is capable of being rearranged as is illustrated in FIG. 3. In FIG. 3, the right handgrip 21 is modified with respect to FIG. 2, by roller 25.2 not carrying a portion of elastic element 30. The arrangement of elastic element 30 in FIG. 3 is as follows: Portion 30*a* extends from roller 25.1 to roller 25.1' on the left. The elastic element 30 is then passed about rollers 25.2' and 25.3' and continues as portion 30*d* to roller 25.4 by passing under portion 30*f*. Portion 30*d* is passed over roller 25.4 and continues as portion 30*e* to roller 25.4' and there becomes portion 30*f* that extends between roller 25.4' and roller 25.3 to continue as portion 30*g* from roller 25.3 to roller 25.2' and thence as portion 30*h* between roller 25.2' and roller 25.1. It will be appreciated that the foregoing description refers to the winding of the elastic element 30 about the eight rollers in the illustrated manner to achieve a six portion configuration of the elastic element 30 between the handgrip 21 and the handgrip 21'. In comparison with the configuration illustrated in FIG. 2, a greater resiliency of the elastic element 30 is produced thereby to permit carrying out of less strenuous physical exercises with my expander type exercise device 20.

As mentioned, merely by way of example, the distance between the handgrips 21 and 21' in FIG. 2 may be approximately 32 inches (81.3 cm).

By temporarily removing, for example, roller 25.2 at handgrip 21, to remove the loop of elastic element 30 that was passed about roller 25.2, upon stretching elastic element 30 between the handgrips 21 and 21', according to FIG. 3, the distance between the handgrips 21 and 21' is increased to approximately 48 inches (1.22 m).

Figure 13:
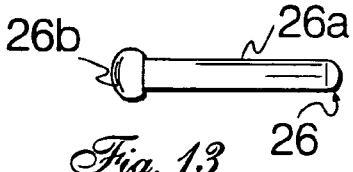
FIG. 13 is side view of a pin member to secure a roller element in a handgrip in accordance with one embodiment of my present invention.

For sake of convenience so as not to misplace the roller 25.2 and its corresponding pin 26, (FIG. 2) which pin 26 is illustrated in greater detail in FIG. 13, the roller 25.2 may be conveniently re-connected by way of its corresponding pin 26.

Figure 4:
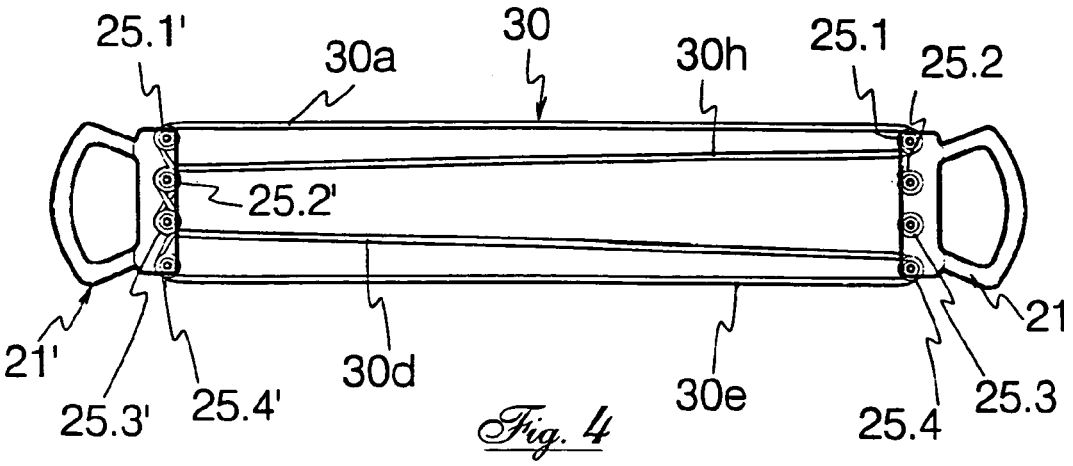
FIG. 4 is a further diagrammatic representation of the expander type exercise device with utilization of four portions of the elastic element in another arrangement in accordance with one embodiment of my present invention.

With reference to FIG. 4, the elastic element 30 is disposed in four portions about the rollers 25, as follows: Portion 30*a* extends between handgrips 21 and 21', over roller 25.1 and under roller 25.2' and thence over roller 25.3'. From roller 25.3' the portion 30*d* extends over roller 25.4, and portion 30*e* extends from roller 25.4 to roller 25.4', thence under roller 25.3' and over roller 25.2', and, as portion 30*h*, to roller 25.1. In other words, in order to achieve the described configuration of elastic element 30 according to FIG. 4, the rollers 25.2 and 25.3 are removed, by removing the corresponding pins 26, and by pulling the elastic element 30 between the handgrips 21 and 21'. The rollers 25.2 and 25.3 that were temporarily removed can be conveniently remounted by inserting the corresponding pin 26 through the bores 25*c* (FIGS. 11 and 12) in the rollers 25 and the bores 24*h* (FIGS. 6, 7, and 8) in handgrips 21 and 21'.

Figure 5:
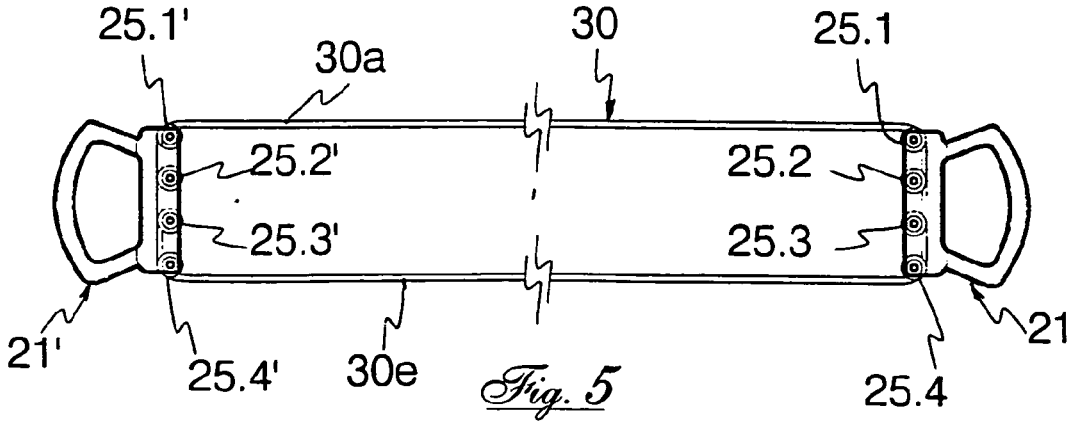
FIG. 5 is a further diagrammatic representation of the expander type exercise device with utilization of two portions of the elastic element in another arrangement in accordance with one embodiment of my present invention.

With references to FIG. 5, the elastic element 30 is disposed with portion 30*a* about rollers 25.1 and 25.1' and with portion 30*e* about rollers 25.4.' and 25.4.

As has been mentioned, merely by way of example, the distance between the handgrips 21 and 21' in FIG. 2 may be approximately 32 inches (81.3 cm). In FIG. 3 the distance may possibly be 48 inches (1.22 m). In FIG. 4 the distance may possibly be 56 inches (1.42 m). In FIG. 5 the distance may possibly be 93 inches (2.36 m). Each increase of the distance is affording a reduction of the force that is to be applied by a user. The full length of the elastic element may be approximately 15 feet (4.55 m) to approximately 16 feet (4.85 m), it being understood that these dimensions are merely examples of possible embodiments and that other dimensions are within the scope of my present invention It will be appreciated that elastic element 30 has two ends that are suitably joined, such as, by clamping or by a connection with a cylindrical structure that is disposed at the adjacent ends of the elastic element 30 and the ends and the pin structure are fastened together to provide a continuous elastic element 30 that is placed about the rollers or pulleys 25, as described herein above.

Figure 6:
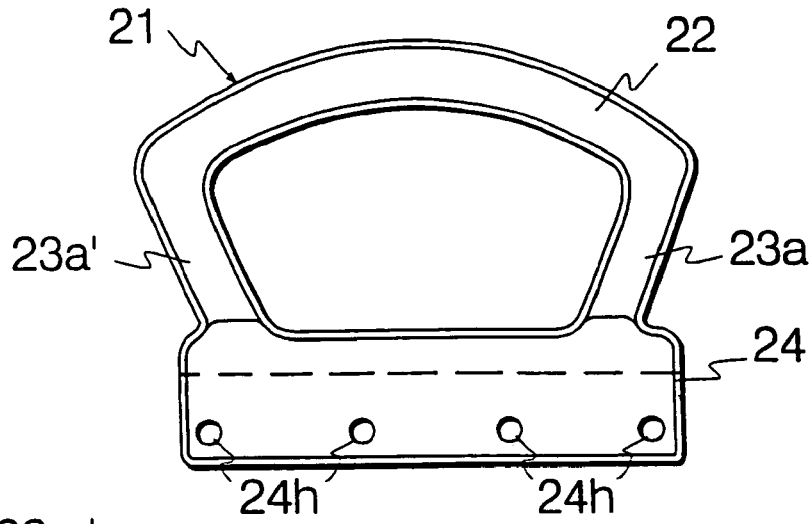
FIG. 6 is a front view of a handgrip for the expander type exercise device in accordance with one embodiment of my present invention.

FIG. 6 illustrates a handgrip 21. Handgrip 21 comprises a curved grip or handle portion 22, it being understood that grip portion 22 may be straight. The grip portion 22 may be hollow, or solid, and may have flattened exterior sides, such as described with reference to FIGS. 2A and 2B. The grip portion 22 comprises lateral portions 23*a* and 23*b*. These lateral portions may be disposed at an angle of inclination as is shown, or they may be filly perpendicular, and other configurations of the handgrip portion 22 are within the scope of my invention.

A portion or structure, generally identified by reference numeral 24 is disposed next to lateral portions 23*a* and 23*a*'. This portion 24 is configured to receive and dispose a set of rollers 25. In the embodiment of FIG. 5, four holes 24*h* are arranged in a straight line and equally distributed at and along the lower side of portion 24. The holes 24*h* are dimensioned to receive a pin 26 in accordance with FIG. 13 or 13A, with a slight press fit so as to preclude a pin 26 from wandering out of the hole 24*h* upon use of the device 20.

Figure 7:
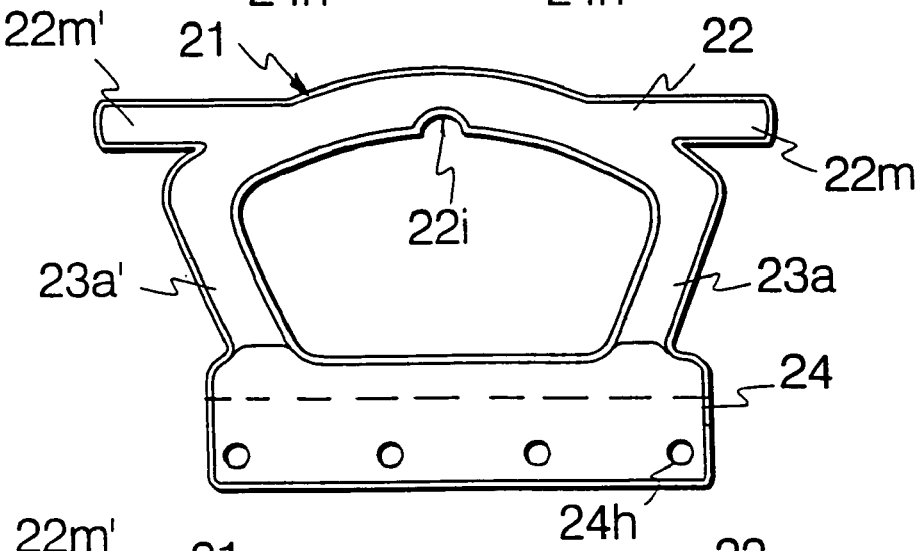
FIG. 7 is a front view similar to FIG. 6 illustrating a further embodiment of a handgrip in accordance with one embodiment of my present invention.

FIG. 7 illustrates a further embodiment of a handgrip 21. Handgrip 21 comprises a curved grip or handle portion 22, lateral portions 23*a* and 23*a*', and a portion or structure, generally identified by reference numeral 24, as described above. The handle portion 22 has a centrally disposed notch 22*i* as well as support formations or projections 22*m* and 22*m*' that are lateral continuations of the curved grip portion 22. The projections 22*m* and 22*m*' serve to permit a more secure and supported grip of the handgrip 21 according to FIGS. 7 and 8. The notched portion 22*i* serves to dispose the handgrip 21 on a support structure as will be described in greater detail below.

Figure 8:
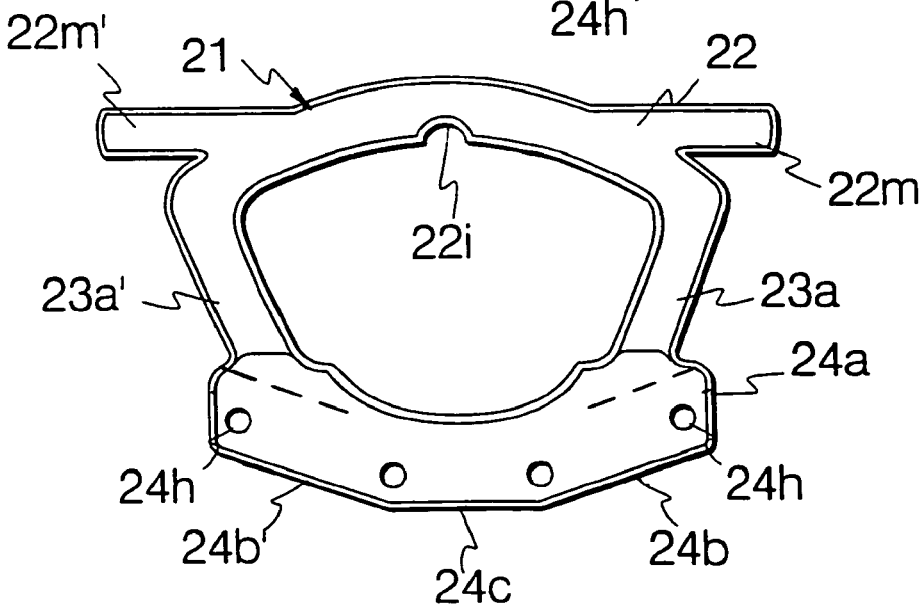
FIG. 8 is a front view similar to FIG. 6 of another embodiment of a handgrip in accordance with one embodiment of my present invention.

FIG. 8 illustrates another embodiment of a handgrip 21. This handgrip 21 comprises, as described above, a curved grip or handle portion 22, lateral portions 23*a* and 23*b*, a portion or structure, generally identified by reference numeral 24, a centrally disposed notch 22*i* as well as support formations or projections 22*m* and 22*m*' that are lateral continuations of the curved grip portion 22. The handgrip 21 as shown in FIG. 8 comprises an arched roller element support portion 24. Thus, the roller support portion 24 comprises a straight portion 24*b* that is inclined from the horizontal at a desired angle. The portion 24 further comprises a straight, horizontal, portion 24*c*, and a further portion 24*b*' that is inclined from the horizontal symmetrical with respect to the right portion 24*b*. It will be appreciated that the holes 24*h* are disposed in a pattern that follows the arch configuration of the sides 24*b*, 24*c*, and 24*b*' of portion 24. It is within the scope of my present invention that the portion 24 has other peripheral configurations, other than described herein.

Figure 9:
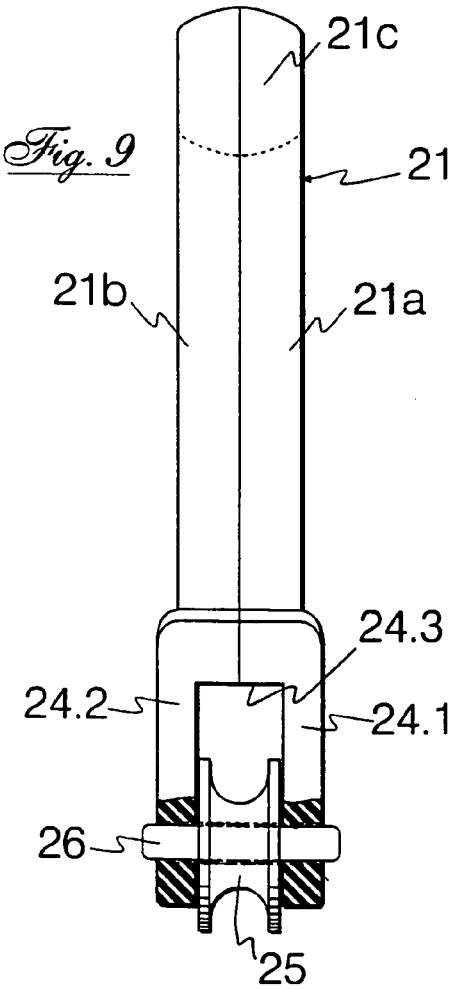
FIG. 9 is a side elevation of a handgrip in accordance with one embodiment of my present invention.

FIG. 9 shows a handgrip 21 in side elevation. FIG. 9 illustrates most clearly the fork-structure of portion 24, with a first tine or wall portion 24.1 and a second tine or wall portion 24.2.

It will be appreciated that the tines or walls 24.1 and 24.2 form a groove 24.3 to mount and dispose the corresponding rollers 25. It is one advantage of my invention that the handgrip 21 may be comprised of two halves, such as, 21*a* and 21*b*, that are suitably joined to one another to provide favorable economics in producing my device.

Figure 10:
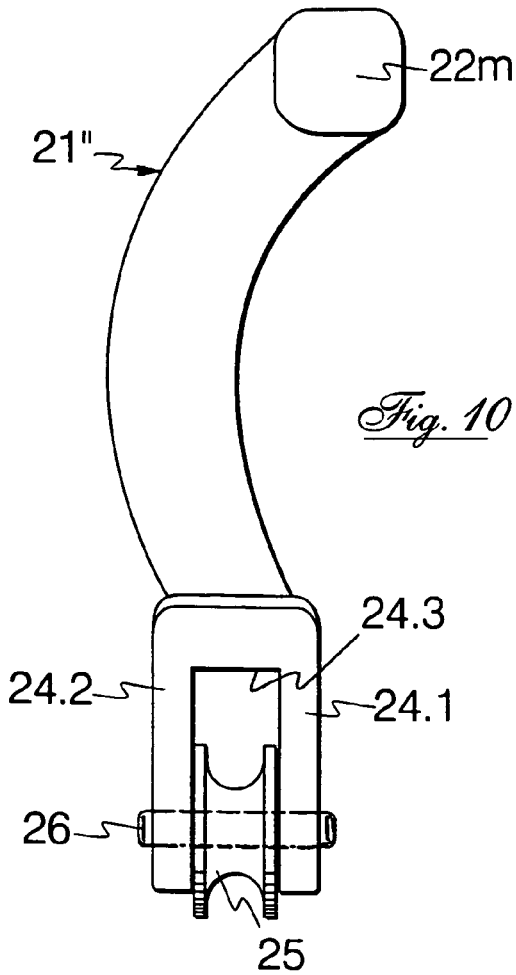
FIG. 10 is a side view similar to FIG. 9 and illustrating another embodiment of a handgrip in accordance with one embodiment of my present invention.

FIG. 10 illustrates a curved handgrip 21", this embodiment otherwise comprising the structures of the embodiment shown in FIG. 9.

Hand grip 21 may be of any desired material and may comprise a molded plastic in any desired color and may be a translucent material.

Figure 11:
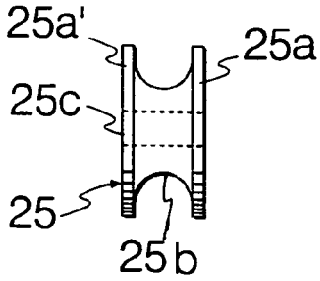
FIG. 11 is a side view of a roller element in accordance with one embodiment of my present invention.

FIG. 11 shows the side elevation of a roller element or roller 25. Thus, roller 25 has lands or rims 25*a* and 25*a*' between which extends a hemispherical groove 25*b*. Roller 25 has a centrally disposed hole 25*c* that is configured to receive a pin 26.

Figure 12:
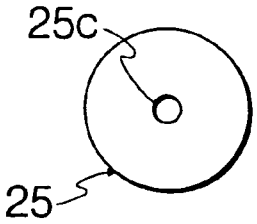
FIG. 12 is a front view of the roller element according to FIG. 11.

FIG. 12 shows the front elevation of the roller 25 shown in FIG. 11.

Figure 13A:
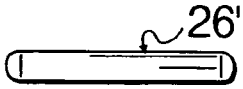
FIG. 13A is a side view similar to FIG. 13 of a pin member in accordance with another embodiment of my present invention.

FIG. 13 shows a pin 26 with a shank portion 26*a* and a head portion 26*b*. It will be appreciated that a fully straight pin 26' as shown in FIG. 13A may be used to mount and dispose a roller 25 in the portion 24 of handgrip 21.

Figure 14:
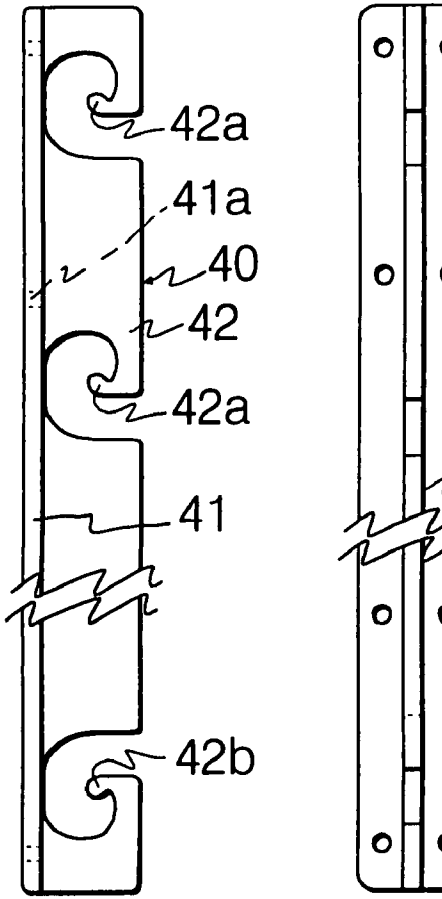
FIG. 14 is a side view of a retainer profile structure having hooks, to receive a handgrip, in accordance with one embodiment of my present invention.
Figure 15:
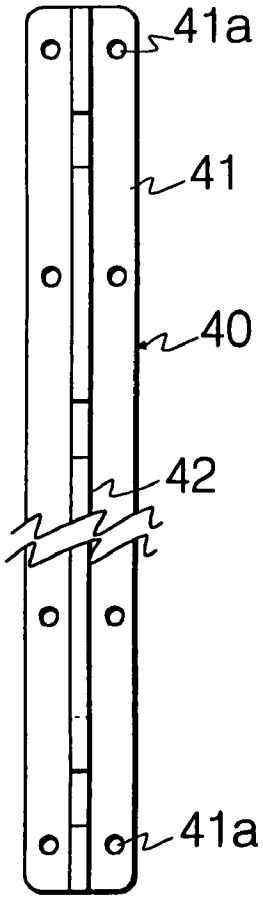
FIG. 15 is a front view of the retainer profile structure according to FIG. 14.
Figure 18:
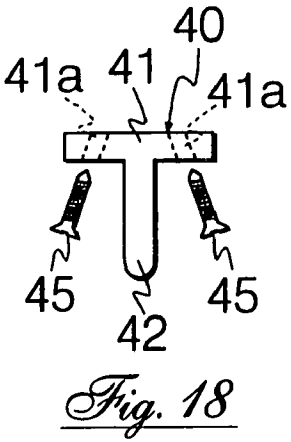
FIG. 18 is a top plan view of the retainer profile structure according to FIGS. 14 and 15 and fasteners to secure the respective retainer profile structure.

FIGS. 14, 15, and 18 illustrate a first retainer profile or support structure 40 with a base portion 41. The base portion 41 has slanted apertures 41*a* (compare FIG. 18) for fastening structure 40 to a solid, wooden or the like, base by means of screws or similar fasteners 45. The structure 40 has a web portion 42 with a plurality of spaced apart hook portions 42*a* that are configured to retain a handgrip 21 and particularly engage the notched portion 22*i* of a handgrip 21 during an exercise in which one handgrip 21 is secured at a hook portion 42*a* and the other handgrip 21' is manipulated by a user 10 during an exercise. The hook portion 42*a* is particularly used for exercises with upper body portions, and lower body portions may be exercised by engaging a handgrip 21 at a lower look portion 42*b*.

Figure 16:
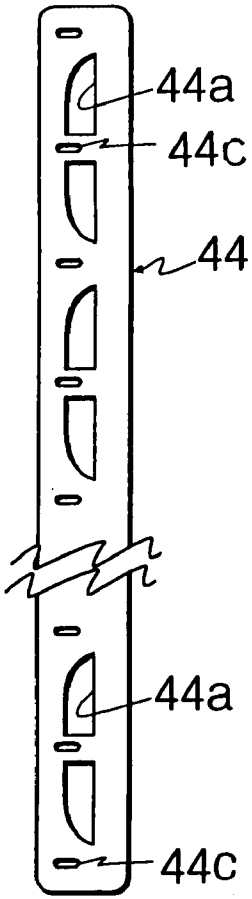
FIG. 16 is a front view of a further retainer profile structure in accordance with one embodiment of my present invention.
Figure 19:
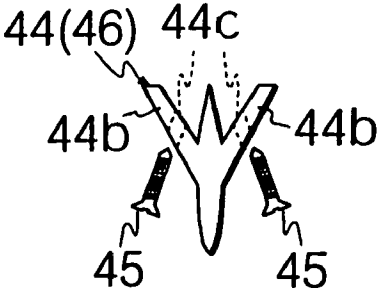
FIG. 19 is a top plan view of the retainer profile structures according to FIGS. 16 and 17 and fasteners to secure the respective retainer profile structure.

FIG. 16 and in conjunction with FIG. 19 illustrates a further retainer profile or support structure 44. The cross-section of structure 44 is shown in FIG. 19 and comprises a substantially triangular configuration that has legs 44*b* with slanted passages 44*c* for fasteners 45. The structure 44 has apertures 44*a* for a connection to a handgrip 21 by an intermediate means as will be described in greater detail below.

Figure 17:
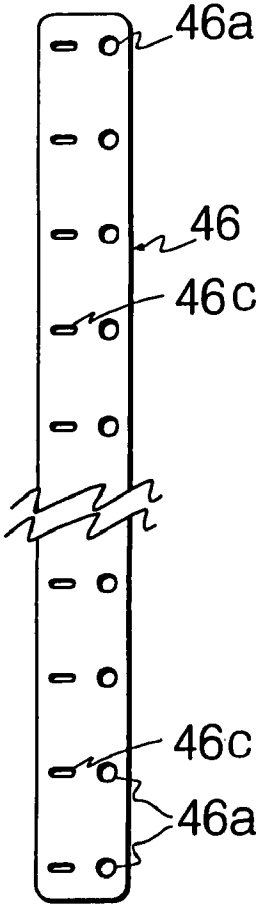
FIG. 17 is a front view of yet another embodiment of a retainer profile structure in accordance with one embodiment of my present invention.

FIG. 17 in conjunction with FIG. 19 illustrates another embodiment of a retainer profile or support structure. Thus, support structure 46 has holes 46*a* for a connection to a handgrip 21 by an intermediate means as will be described in greater detail below.

Figures 20, 21, 22, 23:
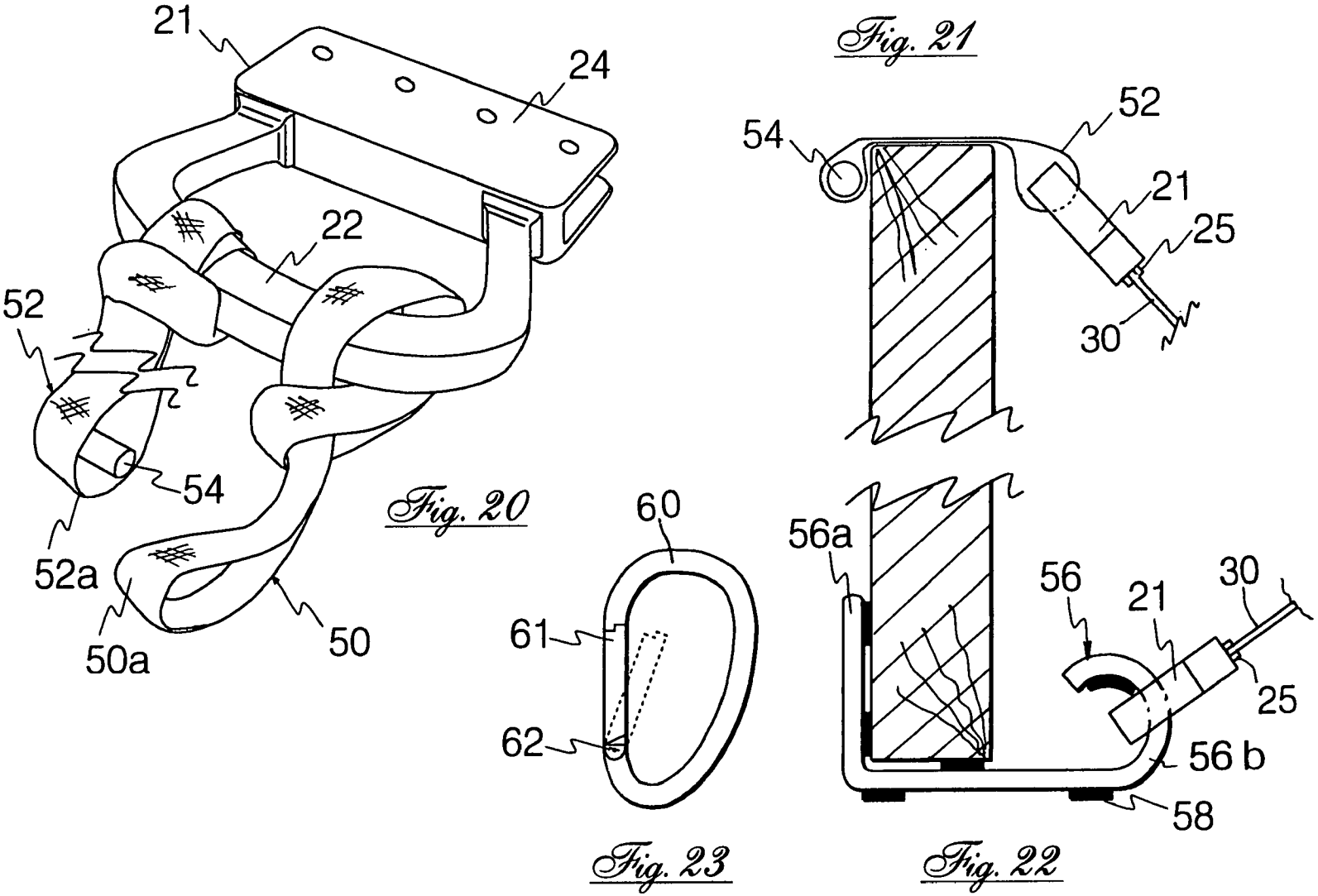
FIG. 20 is a perspective view of a handgrip with two types of belting arrangements that may be used with the exercise device.
FIG. 21 is a cross-sectional view illustrating the arrangement of a belting for holding a handgrip at the top of a door.
FIG. 22 is a cross-sectional view illustrating the arrangement of a hook member that may be disposed at the bottom of a door to engage with a handgrip.
FIG. 23 is a side elevation of a snap type key ring element for connecting a handgrip of an expander type exercise device to a retainer structure according to one of FIGS. 14, 16, and 17.

FIG. 20 is a perspective view of a handgrip 21. Two possible uses are depicted in this illustration.

A first strap, belting, or band 50 is tied about handgrip 21, that is, handle portion 22. The strap has a loop 50*a* that may be placed around the head of a user 10. The opposite handgrip, say handgrip 21' is then engaged at a structure such as shown in FIG. 14, with a notch 22*i* being engaged at hook 42*a* or 42*b*. The user 10 is then able to exercise using pulling movements of his head, for example. A user 10 could also use his leg or an arm with this arrangement.

A further strap, belting, or band is designated 52 that is also knotted about handle portion 22 and the loop 52 carries a pin 54. The strap or belting may be a ¾ of an inch (19 mm) wide by 20 inches (5 cm) long strap with a thickness of 1/16 of an inch (1.59 mm). There may be a 1 inch (25.4 mm) overlap that is stapled together with ⅜ of an inch (9.55 mm) staples, say 12 staples, or the ends may be sewn together. Pin 54 may be a wooden ⅜ of an inch (9.51 mm) diameter dowel pin that is ⅞ of an inch (22 mm) long. The use of this strap 52 with pin 54 is shown in FIG. 21. Thus, the strap 52 is placed about the upper edge of a door with the pin 54 being disposed exteriorly and the handgrip 21 to which the strap 52 is tied or knotted is being disposed in a room. By disposing the handgrip near the top of a door, the user can exercise upper portions of his body.

A possibility to perform exercises near the ground is illustrated in FIG. 22. FIG. 22 shows a hook element 56 that has a first arm 56*a* and a hook portion 56*b*. Hook element 56 has pads 58 that protect a door and the floor. A handgrip 21 of device 20 can be engaged at hook portion 56*b* and the other handgrip 21' can be used to pull against the force imparted at handgrip 21.

A key ring such as 60 that is shown in FIG. 23 may be used as an intermediate connecting element between a handle 21 and a support structure such as support structure 44 or support structure 46, that is, the respective holes or apertures 44*a* and 46*a* Thus, key ring or snap ring 60 has an arm 61 that can pivot about pivot 62.

Figure 24:
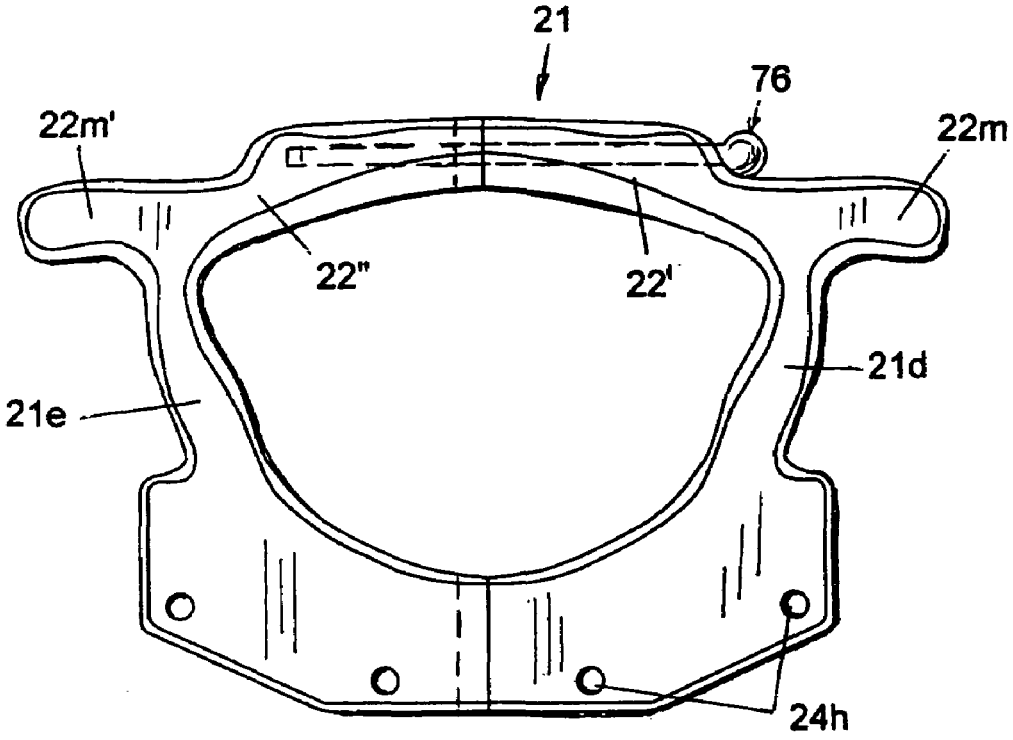
FIG. 24 is an elevation of a handgrip comprising two portions connectable to one another.
Figure 25:
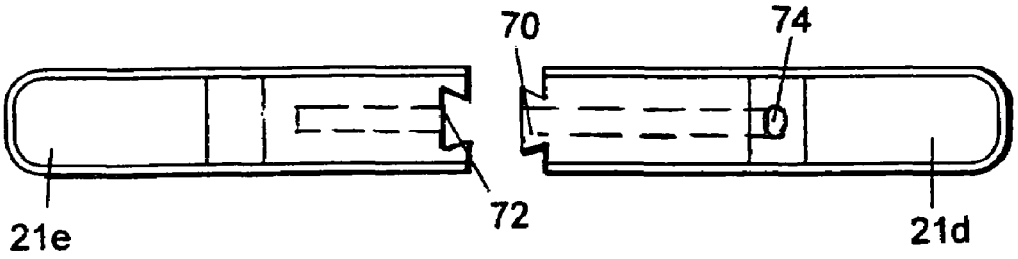
FIG. 25 is a top plan view of the handgrip in accordance with FIG. 24.

FIG. 24 illustrates an embodiment of a handgrip 21 that comprises a right portion 21*d* and a left portion 21*e*. The two portions are joined by a dove-tail connection that comprises a projection 70 and a recess 72, as well as a connector 76 that extends through a passage 74 between the connected handgrip portions 21*d* and 21*e*. It is a feature of my invention that the separated handgrip portions 21*d* and 21*e* are in turn configured as handgrips with lateral members 22' and 22*m* at handgrip portion 21*d* and correspondingly with lateral members 22" and 22*m*' for handgrip portion 21*e*. Such separated handgrip portions can be used in conjunction with an opposite handgrip 21' that may be hooked to a respective hook to carry out corresponding three-point exercises that make it desirable to exercise both arms with different tensile efforts, for example.

Figure 26:
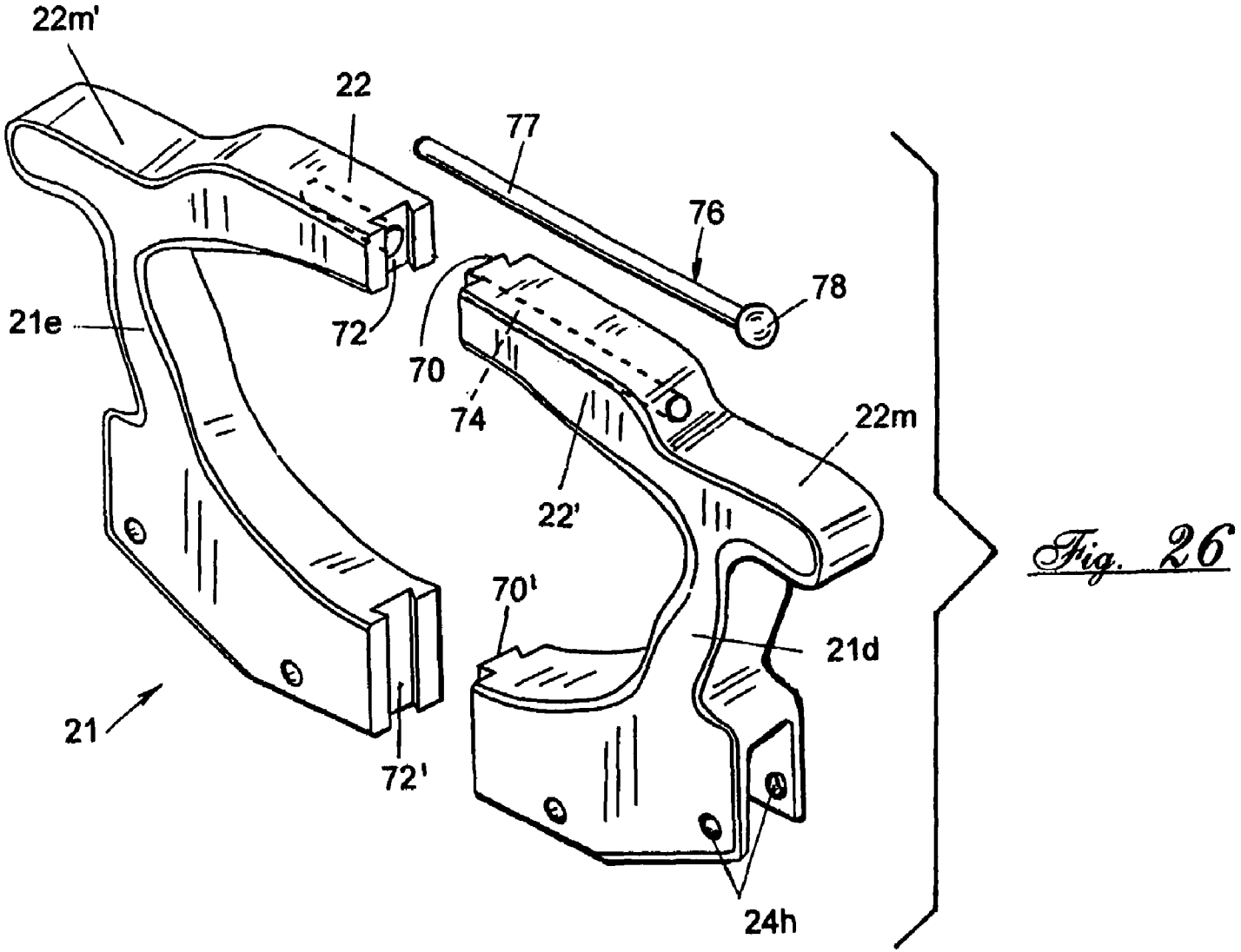
FIG. 26 is a perspective view of the handgrip of FIG. 24 showing a connector in removed position.

FIG. 26 makes it clear that the right handgrip portion 21*d* has a projection 70' and left handgrip portion 21*e* has a corresponding recess 72'. The connector 76 may comprise a shaft portion 77 that extends in the passage 74 to positively secure the handgrip portions together and a head 78 that can be easily grasped for removal when it is desired to use the separated handgrip portions 21*d* and 21*e*.

Some examples of exercises that may possibly be performed with Applicant's expander type exercise device may be found in the following U.S. Pat. No. 4,544,155 issued to Wallenbrock et al. on Oct. 1, 1985 and entitled "Exercise Device with stretchable elastomeric line;" U.S. Pat. No. 4,733,862 issued to Miller on Mar. 29, 1988 and entitled "Elastic resistance exerciser;" U.S. Pat. No. 5,769,764 issued to Tilberis on Jun. 23, 1998 and entitled "Tension-torsioner exercising device;" U.S. Pat. No. 5,813,954 issued to Wilkinson on Sep. 29, 1998 and entitled "Buttock exercise device;" U.S. Pat. No. 6,036,625 issued to Woodruffon Mar. 14, 2000 and entitled "Upper body exercise equipment;" and U.S. Pat. No. 6,053,851 issued to Tu on Apr. 25, 2000 and entitled "Body exerciser." All of the foregoing patents are hereby incorporated by reference as if set forth in their entirety herein.

Some examples of exercises devices with rollers, features of which may possibly be used or adapted for use in at least one possible embodiment of the present invention, may be found in the following U.S. Pat. No. 741,966 issued to Hernsheim on Oct. 20, 1903 and entitled "Exercising device;" U.S. Pat. No. 2,035,010 issued to Rawlings on Mar. 24, 1936 and entitled "Apparatus for providing physical health treatment;" U.S. Pat. No. 4,645,204 issued to Berger on Feb. 24, 1987 and entitled "Compact portable exercising apparatus;" U.S. Pat. No. 4,961,573 issued to Wehrell on Oct. 9, 1990 and entitled "Boxing exercise harness;" U.S.

Pat. No. 5,358,461 issued to Bailey, Jr. on Oct. 25, 1994 and entitled "exerciser activated body-mounted lights and generator;" U.S. Pat. No. 5,484,368 issued to Chang on Jan. 16, 1996 and entitled "Multi-function pull bar;" U.S. Pat. No. 5,509,873 issued to Corn on Apr. 23, 1996 and entitled "Exercise device with adjustable resistance;" U.S. Pat. No. 5,586,962 issued to Hallmark on Dec. 24, 1996 and entitled "Multiple sport training and exercise apparatus;" and U.S. Pat. No. 5,733,231 issued to Corn et al. on Mar. 31, 1998 and entitled "Exercise device with variable resistance." All of the foregoing patents are hereby incorporated by reference as if set forth in their entirety herein.

The components disclosed in the various publications, disclosed or incorporated by reference herein, may be used in the embodiments of the present invention, as well as equivalents thereof. The appended drawings in their entirety, including all dimensions, proportions and/or shapes in at least one embodiment of the invention, are schematically accurate and are hereby included by reference into this specification. All, or substantially all, of the components and methods of the various embodiments may be used with at least one embodiment or all of the embodiments, if more than one embodiment is described herein. All of the patents, patent applications and publications recited herein, and recited in the Declaration attached hereto, and the references recited in such incorporated references are hereby incorporated by reference as if set forth in their entirety herein. AU of the references and documents, cited in any of the documents cited herein, and the references they are in turn cited in, are hereby incorporated by reference as if set forth in their entirety herein. All of the documents cited herein, referred to in the immediately preceding sentence, include all of the patents, patent applications and publications cited anywhere in the present application. All of the references included herein as aforesaid include the corresponding equivalents published by the United States Patent and Trademark Office and elsewhere. The details in the patents, patent applications and publications may be considered to be incorporable, at Applicant's option, into the claims during prosecution as further limitations in the claims to patentably distinguish any amended claims from any applied prior art. The details in the patents, patent applications and publications may be considered to be incorporable, at Applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses, if any, are intended to cover the structures described herein as performing the recited function and not only structural equivalents but also equivalent structures.

The invention as described hereinabove in the context of the preferred embodiments is not to be taken as limited to all of the provided details thereof since modifications and variations thereof may be made without departing from the spirit and scope of the invention.

The embodiments of the invention in which an exclusive property or privilege is claimed are defined as follows:

1. An exercise device of the class of expander type exercisers and strand pulling exercisers in which an elastic member that is capable of expansion and contraction is disposed between a pair of handgrips that are configured to expand the elastic member for physical workout exercises by a user, said exercise device comprising:

(a) a first handgrip and a second handgrip;

each handgrip comprising a handle portion being configured to be held by a user;

each handle portion comprising a first plane;

said first plane comprising a substantial vertical plane when a corresponding handgrip is held by a band of a user;

each handle portion comprising a base portion being configured with a groove to mount a plurality of roller elements;

each grooved base portion disposing a corresponding groove opening in the direction remote from a corresponding handle portion;

(b) a group of at least four roller elements being configured to be mounted in the grooved base portion of said first handgrip;

a group of at least four roller elements being configured to be mounted in the grooved base portion of said second handgrip;

each roller element having a longitudinal axis of rotation being disposed to extend transversely in reference to a corresponding first plane of a corresponding handgrip;

each roller element comprising a circumferential groove disposed transversely in reference to a corresponding longitudinal axis of a corresponding roller element;

(c) for each roller element a shaft structure being configured to be disposed in a corresponding grooved base portion and also being configured to mount a corresponding roller element in a corresponding grooved base portion; and (d) a single elastic strand element being configured to expand upon being pulled by a force of pull and being configured to contract upon release of a force of pull;

said single elastic strand element being configured to be selectively disposed about said group of at least four roller elements of said first handgrip and said group of at least four roller elements of said second handgrip and between said first handgrip and said second handgrip in a first formation and in at least one other formation;

said first formation comprising eight portions of said single elastic strand element being disposed about said group of at least four roller elements of said first handgrip and also about said group of at least four roller elements of said second handgrip, and between said first handgrip and said second handgrip;

said at least one other formation comprising four portions of said single elastic strand element being disposed about at least two roller elements of said group of at least four grooved roller elements of said first handgrip and about at least two grooved roller elements of said group of at least four roller elements of said second handgrip, and between said first handgrip and said second handgrip.

2. The exercise device according to claim 1, wherein: each handgrip comprises a plastic molded structure.

3. The exercise device according to claim 2, wherein: each handgrip comprises a first portion and a second portion being connectable to one another.

4. The exercise device according to claim 1, wherein: said single elastic strand element comprises a tubing material.

5. A kit for performing physical workout exercises, said kit comprising:

(A) an expander type exercise device for use in performing physical workout exercises by a user, said exercise device comprising;

(a) a first handgrip and a second handgrip;

each handgrip comprising a handle portion configured to be grasped by a hand of a user;

each handle portion comprising more than one mounting portion configured and disposed to removably dispose a guide element;

(b) more than one guide element, the more than one guide element being rollers;

each said more than one guide element being configured to be removably disposed in said at least one mounting portion configured and disposed to removably dispose a guide element, of a corresponding handle portion of each said first handgrip and said second handgrip;

(c) for each said more than one guide element, more than one structure being configured to dispose a corresponding guide element for rotation at a corresponding handgrip; and (d) an elastic element being configured to be disposed as an endless band about the respective guide elements of said first handgrip and also about the respective guide elements of said second handgrip to permit expansion and contraction of said elastic element between said first handgrip and said second handgrip upon performing physical workout exercises, the elastic element being configured by the guide elements into at least four portions disposed between said respective guide elements of said first handgrip and said respective guide elements of said second handgrip; and (B) a structure configured to be secured at one of: a wall and a door of a room;

said structure also being configured to connect a handgrip for performing physical exercises.

6. The kit according to claim 5, comprising:

at least one of: (a) and (b), wherein in (a) and (b) comprise:

(a) fasteners to secure a structure being configured to be secured at one of: a wall and a door of a room; and (b) an arrangement to connect a handgrip to a structure being configured to be secured at one of: a wall and a door of a room.

7. An expander type exercise device for use in performing physical workout exercises by a user, said exercise device comprising:

(a) a first handgrip and a second handgrip;

each handgrip comprising a handle portion being configured to be grasped by a hand of a user;

each handle portion comprising a retaining portion being configured and disposed to removably retain guide elements;

(b) more than one guide element for each handgrip, said guide elements being cylindrical pulleys;

said guide elements being configured to be removably disposed in said retaining portion of each handgrip;

(c) a pin structure being configured to rotatably and removably mount guide elements in said retaining portion of each handgrip; and (d) an elastic element being configured to be disposed as an endless band about said guide elements of said first handgrip and also about said guide elements of said second handgrip to permit expansion and contraction of said elastic element between said first handgrip and said second handgrip upon performing physical workout exercises.

8. The exercise device according to claim 7, wherein:

said pulleys have a hemispherical groove being configured to guide a portion of said elastic element.

9. The exercise device according to claim 8, wherein:

a group of four pulleys is disposed at a respective handgrip.

10. The exercise device according to claim 9, wherein:

at least one of said first handgrip and said second handgrip comprises a plastic molded structure.

11. The exercise device according to claim 10, wherein:

at least one of said first handgrip and said second handgrip comprises a first portion and a second portion being connectable to one another.

12. The exercise device according to claim 11, wherein:

said elastic element comprises an elastic tubing material.

13. The exercise device according to claim 12, wherein:

said elastic tubing material is equivalent to THERA-BAND™ material.

14. The exercise device according to claim 13, wherein at least one of said first handgrip and said second handgrip comprises at least one hand-supporting structure projecting away from a corresponding handgrip.

15. The exercise device according to claim 14, wherein:

at least one said first handgrip and said second handgrip comprises a notched portion.

16. The exercise device according to claim 15, wherein:

one of: said first handgrip and said second handgrip, comprises one of (a) and (b), wherein (a) and (b) comprise:

(a) a hollow cross-section; and (b) a solid cross-section.

17. The exercise device according to claim 16, wherein:

said retaining portion comprises a first wall and a second wail remote from said first wall to dispose at least one cylindrical pulley structure there between.

* * * * *